United States Patent [19]

Tuscher et al.

[11] 4,160,709

[45] Jul. 10, 1979

[54] PROCESS FOR THE GALVANIC DEPOSITION OF NICKEL FROM A NICKEL BATH

[75] Inventors: Otto Tuscher, Munich; Karl Butter, Ottobrunn; Kuno Knauer, Jakobneuharting, all of Fed. Rep. of Germany

[73] Assignee: Messerschmitt-Bolkow-Blohm GmbH, Munich, Fed. Rep. of Germany

[21] Appl. No.: 904,492

[22] Filed: May 10, 1978

Related U.S. Application Data

[63] Continuation of Ser. No. 750,688, Dec. 15, 1976, abandoned.

[30] Foreign Application Priority Data

Dec. 23, 1975 [DE] Fed. Rep. of Germany ..... 2558423

[51] Int. Cl.[2] ..... C25D 3/12

[52] U.S. Cl. ..... 204/49; 204/237; 204/DIG. 13

[58] Field of Search ..... 204/49, 237, 238, 239, 204/240, 241, 282, DIG. 13

[56] References Cited

U.S. PATENT DOCUMENTS

| | | | |
|---|---|---|---|
| 3,326,782 | 6/1967 | Kendrick et al. | 204/49 X |
| 3,990,955 | 11/1976 | Dill | 204/49 |

FOREIGN PATENT DOCUMENTS

| | | | |
|---|---|---|---|
| 1101093 | 1/1968 | United Kingdom | 204/49 |

OTHER PUBLICATIONS

L. Serota, Metal Finishing, pp. 59–61, Jul., 1962.
J. L. Marti et al., Plating, pp. 377–385, Apr., 1969.
J. K. Dennis et al., "Nickel and Chromium Plating," pp. 65–67, 77, 79 & 138–145, (1972).

*Primary Examiner*—G. L. Kaplan
*Attorney, Agent, or Firm*—Toren, McGeady and Stanger

[57] ABSTRACT

A method for galvanic deposition of nickel from an electrolyte containing nickel sulfamate and nickel chloride is disclosed wherein the formation of intermediate products resulting from the oxidation of nickel sulfamate and the escape of anode sludge into the electrolyte are controlled to such an extent so as to reduce the amount of sulfur incorporated in the deposition to less than about 15 ppm.

This results in avoidance of brittleness in the nickel deposition at high temperatures and allows the coated article to be welded. These properties were difficult or impossible to obtain in the prior art processes.

3 Claims, No Drawings

PROCESS FOR THE GALVANIC DEPOSITION OF NICKEL FROM A NICKEL BATH

This is a continuation of application Ser. No. 750,688, filed on Dec. 15, 1976, now abandoned.

BACKGROUND OF THE INVENTION

1. Field of the Invention

The invention relates to a process for the galvanic deposition of nickel from nickel sulfamate and nickel chloride containing electrolytes using nickel anodes in bags.

2. Description of the Prior Art

The galvanic deposition of thick nickel layers is used to an increasing extent because, using this method, nickel plated objects having complex shapes can be produced economically, even in small numbers. Preferably, an electrolyte is used for this process consisting of nickel sulfamate to which nickel chloride has been added in order to improve the anode solubility.

Furthermore, processes are known in which nickel plates or nickel pellets, inserted into titanium or plastic baskets, are used as anodes. These are suspended in narrow-meshed bags in the electrolyte bath, in order to collect the anode sludge.

In manufacturing hollow parts or other component parts, which are galvanically formed with nickel deposits, and which consist of several individual parts, the joined individual parts could hitherto only be bonded and sealed at the joints by means of partial galvanoplastic processes. This was necessary, because the galvanically deposited nickel was regarded as not being weldable because that region of the component part, which was heated to above 400° C. during the welding, became totally brittle. The cause for this presumably lies within the sulfur portion which is deposited at the same time in the galvanic nickel and that is partially dissolved as nickel sulfide. With increasing temperature, this material collects, to an increasing degree, at the grain boundaries and leads to the formation of a nickel-nickel sulfide eutectic at that point. On heating, the resulting phase diffuses from this point at a rather high rate, into the depth of the nickel material. In fact, the diffusion of the nickel-nickel sulfide eutectic occurs only when the melting point of the eutectic is reached. This melting point is about 645° C. However, the diffusion process, at a lesser rate, can be detected from 400° C. onwards. A marked brittleness of the material can be detected at those sites of the nickel structure, that were reached by the diffusing nickel sulfide phase, and that were subsequently mechanically stressed.

These facts have been documented, but there is no data in the literature concerning the temperature strength relationships, and especially concerning the 0.2% yield strength of galvanic nickel deposits at temperatures above 650° C. or that the values for the tensile strength decrease rapidly at temperatures above 400° C.

In spite of the fact that this disadvantage of galvanically deposited nickel has been known for a longe time, no efforts have hitherto been made to indicate the factors that influence the brittleness that occurs at elevated temperatures and to show how these may be eliminated.

SUMMARY OF THE INVENTION

It is the object of the present invention to create a reproducible process for the galvanic deposition of nickel, which deposition does not become brittle at elevated temperatures and which can also be welded.

The object of the invention is accomplished for a process of the type mentioned hereinabove by reducing the formation of intermediate products, resulting from the oxidation of nickel which consist especially of azodisulfonate, and preventing the escape of anode sludge into the electrolytes to such an extent, that the proportion of sulfur incorporated into the deposited nickel is less than about 15 ppm.

DESCRIPTION OF THE PREFERRED EMBODIMENT

It is indeed known that when using nickel sulfate solutions for producing the nickel layer, oxidation products of the sulfamate, such as, azodisulfonate, persulfate, sulfite and sulfate result, which are partially incorporated into the nickel deposit. In the description of these processes, there is, however, merely a reference to the fact that the sulfur compounds, especially azodisulfonate, have a great influence on the internal tensions of the deposit. To supplement the preceding, the applicant has observed that the azodisulfonate contained in the nickel deposit is decomposed by the effects of high temperature whereby the resulting atomic sulfur, because of its great affinity for nickel, forms a nickel sulfide eutectic. This eutectic melts at ca. 645° C., wets the nickel crystals that it reaches and, in so doing, totally embrittles the nickel deposit.

In order to determine the quantities of azodisulfonate that lead to a complete embrittlement of the whole nickel deposit, a series of investigations was carried out with samples which had been enriched with different proportions of azodisulfonate. X-ray fluorescence methods were used to directly determine the proportion of sulfur which was used as a measure of the enrichment of the sample with azodisulfonate.

It turned out that samples with a sulfur content of up to about 15 ppm did not become brittle at temperatures above 645° C. and did not change their structure even on welding. The strength and elasticity properties, after the heat treatment resulting from the welding, corresponded to those of the original nickel.

In addition to the methods already given in the literature for decreasing the azodisulfonate content, the significance of keeping the electrolyte clean by preventing the escape of anode sludge from the anode protection bags was recognized by the applicants as an important factor in reducing the sulfur content in the deposited nickel.

As a result of the present invention, one can now weld the galvanically deposited nickel which heretofore could not be done.

In order to reduce the formation of oxidation products of nickel sulfamate as much as possible and to produce nickel deposits with reproducibly low sulfur contents, the electrolyte is precleaned, according to a further development of the invention, with about 5 g/l activated charcoal and about 3 ml/l of 30% hydrogen peroxide and is run without wetting agents but with about 15–20 g/l nickel chloride, at a cathode current density of at least 3 amp/dm$^2$. By adhering to these measures, a constantly uniform composition and bath control is achieved, which largely excludes the formation of sulfurizing intermediate products.

According to a further embodiment of the invention, S-nickel anodes are used in the form of plates or pellets, and are exchanged simultaneously up to at most one third of the total anode surface. This hitherto unknown but very important measure is necessary because it was determined during the development of the process that the new nickel anode, because of its initial passivation, favors the formation of oxidation products and especially those of azodisulfonate.

In order to prevent the escape of anode sludge effectively, it is not sufficient to envelop the anodes simply with the usual bags. A close-meshed bag is required first of all, over which there is the usual anode bag. With the use of the cloth bags, however, the exchange of electrolytes from cathode to anode is extremely retarded. Thus, in order to assure that the bath is constantly rotated, the electrolyte is, according to a further development of the invention, constantly suctioned from the anode bag by pumps and returned to the working bath via a selecting bath and a filter pump. Suctioning from the anode bags has the additional advantage that the electrolyte constantly flows into the bag, whereby the escape of sludge is completely prevented and there is a good electrolyte flow over the anodes.

EXAMPLE

For the manufacture of power plant combustion chambers, hollow formed parts are galvanoplastically finished, onto which fittings, such as, inlet or drainage rings, are subsequently to be welded.

The foundations for the galvanoplastic application which consist of copper and are pretreated in the conventional manner, are suspended in a nickel sulfamate bath, which is finally purified with 5 g/l activated charcoal and 3 ml/l hydrogen peroxide and to which 18 g/l nickel chloride are added. Other additives, such as, wetting agents, glosses or levelers, were not used. Pellets of S-nickel, which were in titanium baskets, were used as anodes.

The electrolyte is circulated in the anode basket by means of small filter pumps whose suction lines are inserted in the titanium baskets. During the deposition, the electrolyte is continuously purified, three times per hour, over the activated charcoal sludge filter. A further continuous cathodic purification of the electrolyte takes place in a vessel, separated from the working bath, whereby 15 $dm^2$ selective cathode sheets are required for 1000 l of bath liquid. In so doing, the current density must constantly vary between 0.05 and 0.03 amp/$dm^2$. The deposition of the nickel takes place at a current density of 5 amp/$dm^2$, whereby, from time to time, 20–30% of the total amount of the pellets is replaced.

The nickel coated material of the finished, coated power plant combustion chamber thus obtained has a uniform finely grained structure.

The nickel material, heated locally at about 646° C. by the assembly welding of the inlet and drainage rings, maintains its original strength and shows no brittleness whatsoever. Combustion chambers, manufactured in this way, are fully equal to the leakproof requirements under high mechanical stress and at elevated temperatures, such as are required for space travel devices.

What is claimed is:

1. In a method for the galvanic deposition of nickel from an electrolyte containing nickel sulfamate and nickel chloride using nickel anodes in bags, the improvement which comprises reducing the formation of oxidation products from the nickel sulfamate and reducing the amount of sulfur in the deposited nickel to less than 15 ppm by precleaning the electrolyte and using a nickel chloride concentration of from 15 to 20 g/l and a cathode current density of at least 3 amp/$dm^2$, and preventing the escape of anode sludge into the electrolyte by enveloping the anodes in closed mesh bags prior to covering with the anode bags and suctioning the electrolyte from the anode bags and cycling the electrolyte through a selecting bath to the working bath whereby a weldable nickel is produced.

2. The process of claim 1 wherein the electrolyte is precleaned with about 5 g/l of activated charcoal and about 3 ml/l of 30% hydrogen peroxide.

3. The process of claim 1 wherein S-nickel anodes are used and the nickel anodes in the form of plates or pellets are exchanged at the same time up to at the most $\frac{5}{8}$ of the total anode surface.

* * * * *